United States Patent [19]

Hutt et al.

[11] 3,954,371

[45] May 4, 1976

[54] APPARATUS FOR MAKING BAGS FROM SYNTHETIC PLASTIC FILM

[76] Inventors: Thomas Gough Hutt, 936 Pretorius St., Arcadia, Pretoria, Transvaal, South Africa; Robert Davis, 324 Lunsford Lane, Larkfield, Maidstone, Kent, England

[22] Filed: Dec. 13, 1974

[21] Appl. No.: 532,400

[30] Foreign Application Priority Data

Dec. 21, 1973 South Africa ..... 73/9660

[52] U.S. Cl. ..... 425/327; 93/33 H; 93/34; 93/8 R

[51] Int. Cl.[2] ..... B31B 1/16; B31B 21/00

[58] Field of Search ..... 93/33 H, 33 R, DIG. 1, 93/8 R, 34, 35 R; 156/515, 273; 74/38, 44, 45; 83/627, 630; 425/327

[56] References Cited

UNITED STATES PATENTS

| | | | |
|---|---|---|---|
| 2,206,965 | 7/1940 | Lakso | 93/DIG. 1 |
| 2,698,046 | 12/1954 | Finke | 93/DIG. 1 |
| 2,944,469 | 7/1960 | Heinzer | 93/DIG. 1 |
| 3,054,441 | 9/1962 | Gex et al. | 93/DIG. 1 |
| 3,224,161 | 12/1965 | Conti | 93/DIG. 1 |
| 3,286,005 | 11/1966 | Cook | 93/34 UX |
| 3,499,817 | 3/1970 | Havens et al. | 93/33 H UX |
| 3,804,571 | 4/1974 | Upmeier | 425/327 X |

*Primary Examiner*—James F. Coan
*Attorney, Agent, or Firm*—Karl W. Flocks

[57] ABSTRACT

A bag-making machine which comprises a rotatable roller and feed means for feeding a continuous plastic web onto the roller at the rate of rotation of the roller. The machine has a cutter sealing member disposed transverse to the feed direction of the web, and a link lever system for reciprocating the cutter sealing member during working and return strokes thereof, to displace the cutter sealing member both arcuately and radially relative to the roller. The machine includes cam tracks at opposite ends of the roller and displacing means therefor synchronised with the link lever system, the cutter sealing member having cam followers co-operating with the cam tracks.

An inline bag-making installation including the bagmaking machine, draw rollers upstream of the machine, a printer upstream of the draw rollers, and drive means interconnecting the roller of the bag-making machine and rollers of the printer for synchronous operation.

23 Claims, 18 Drawing Figures

APPARATUS FOR MAKING BAGS FROM SYNTHETIC PLASTIC FILM

This invention relates to apparatus for making bags from synthetic plastic film. It relates more particularly to the extrusion of such film in tubular blown form from an extruder, and the subsequent processing of such film and the making into bags, including the printing of such film.

According to the invention a bag-making machine includes:

a. a cylinder roller having means to rotate it about its axis;

b. feed means adapted to feed a continuous web of heat-sealable synthetic plastic material to the roller at a rate corresponding to the rate of rotation of the roller;

c. a cutter sealing member disposed transversely to the direction of feed of the web;

d. displacing means for cyclically displacing the cutter sealing member arcuately about and radially relative to the roller axis and in synchronism with the roller, the displacing means comprising a link lever system for imparting reciprocating movement to the cutter sealing member to perform a working stroke in a downstream direction, and a return stroke in an upstream direction relative to the direction of feed of the web;

e. cam tracks at opposite ends of the roller and extending in the direction of feed of the web;

f. cam track displacing means adapted to operate in synchronism with the link lever system for displacing the cam tracks cyclically away from the roller axis for a return stroke and towards the roller axis for a working stroke of the cutter sealing member; and g. cam followers on the cutter sealing member adapted to co-operate with the cam tracks;

whereby in operation in following the cam tracks, the cutter sealing member cyclically moves towards and away from the roller axis and seals and cuts the film layers in a direction transverse to the direction of feed of the web, and after such sealing and cutting, moves clear of the web and returns to its initial position for a new cycle of operation.

Thus, in other words, the cutter sealing member will be arranged to perform reciprocal cyclic movements peripherally with the roller, and inwardly and outwardly relative to the roller axis, the periods of such cyclic movements, together with the rate of rotation of the roller and its diameter, determining the length of the bags.

The cam tracks may be provided in members mounted to pivot about an axis parallel to the roller axis, the cam track displacing means comprising link means interconnecting the members to the link lever system. The roller may have a plurality of circumferentially spaced longitudinal slots in its periphery, the cutter sealing member having a blade adapted in operation to register with and to enter into a slot of the roller, there being provided mating formations fast with the roller and with the cutter sealing member respectively, and adapted to engage with each other at the start of a working stroke, and to move in unison with each other during the working stroke over and arc about the roller axis, and to disengage from each other at the end of the working stroke, the mating formations being adapted to ensure, upon inter-engagement with each other, that the cutter blade registers accurately with and remains in registration with a slot in the roller surface during the period of the working stroke, during which period sealing and cutting of the film layers is taking place. The mating formation for the roller may include a toothed wheel fast and co-axial with the roller, the number of teeth of the wheel corresponding to the number of slots in the roller, and the mating formation for the cutter sealing member including at least one tooth adapted to mesh with the said toothed wheel. Such tooth meshing also ensures that the cutter sealing member moves arcuately in unison with the roller over a short arc. The link lever system may include a toothed change wheel having means for driving it in synchronism with the roller, the change wheel having a crank pin or eccentric to which the link lever system is pivotally connected.

The change wheel may thus be a gear wheel and may be rotatably mounted in a bearing support adapted to take change wheels having different numbers of teeth. The position of the bearing support in relation to the roller axis is adjustable such that the centre distance between the change wheel and the toothed wheel meshing with it and co-axial with the roller, may be varied, depending upon the number of teeth of the change wheel.

The change wheel may be in driving engagement with a toothed wheel fast with the roller and co-axial with it, the said toothed wheel having a number of teeth equal to that of the number of slots in the roller. The slots of the roller are conveniently aligned with the spaces between the teeth of the driving toothed wheel coaxial with the roller, and have a width only slightly wider than the cutter sealing member, thus permitting the cutter sealing member to pass with clearance into the slots. The mating formation toothed wheel may be the same wheel or separate from the driving toothed wheel of the roller, but if separate is aligned with the driving toothed wheel and has the same number of teeth. The link lever system may be arranged to reduce the cyclic displacement of the cutter sealing member in a direction transverse to the direction of feed of the web to a value less than the throw of the crank pin or eccentric of the change wheel. The link lever system may include compensating means to compensate automatically for varying center distances resulting from varying diameters of change wheels. The compensating means may include means for automatically shortening or lengthening the effort arm of a lever of the link lever system in response to a changed position of the rotational axis of the change wheel.

The crank pin or eccentric may be at a radius different from the pitch circle radius of the change wheel, proportionating lengths of levers being used in the link lever system.

The roller may be provided with one or more slots extending axially along its periphery. When a plurality of slots is provided they are spaced circumferentially around the roller surface. The working strokes of the cutter sealing member may conveniently be timed in relation to the rotation of the roller, such that the working strokes take place while the cutter sealing member is in alignment with a slot. The working stroke is in fact a cutting and sealing stroke when the cutter sealing member severs the web and enters the slot.

In order to ensure that the layers of the synthetic plastic film forming the web lie snugly on the peripheral surface of the roller, the roller may be made hollow with perforations. This will assist in the synthetic plastic webs being held firmly and snugly against the peripheral surface of the roller by external atmospheric pressure when sub-atmospheric pressure is applied to the inside of the roller. Alternatively or in addition, pneumatic jets may be provided adjacent the cutter sealing member, the jets being spaced in series longitudinally along the length of the cutter sealing member. The jets are arranged to urge the film against the roller. As a further alternative, biassed shoes may be provided upstream and downstream of the cutter sealing member. The shoes may have linings of polytetrafluoroethylene (PTFE) strip. The shoes are intended to press the film against the roller periphery before the cutting and sealing member comes into contact with the film and to hold the film there until after the cutting and sealing member has performed its working stroke and has withdrawn and has parted from the film. This is to prevent the film sticking to the cutting and sealing member. The clearance between the cutter and a biassed shoe should not be more than about half the circumferential pitch of the slots in the drum.

The reciprocal movement of the crank pin in a downstream and upstream direction, is responsible for the movement of the cutter sealing member, first downstream with the peripheral movement of the roller surface, and then upstream against the peripheral movement of the roller surface.

The inward and outward movement of the cutter sealing member relative to the roller axis, is provided by the transverse reciprocal movement of the crank in a direction transversely or at right angles to the direction of feed of the web. Such transverse reciprocal movement is transferred to the cutter sealing member via a lever arrangement forming part of the link lever system and having a mechanical advantage such that the transverse displacement of the cutter and sealing member is a suitable fraction, say, about half the crank throw.

The cutter sealing member may be continuously heated electrically by means of flexible leads. It may be mounted in a carrier having biassed clamps at the ends for placing the member under tensile stress, thereby to stretch it to prevent buckling when it heats up.

The roller may be provided with a plurality of circumferentially extending axially spaced narrow grooves adapted to accommodate stripper or take-off members with clearance. These stripper members are adapted to strip the film from the roller and to present it to take-off rollers.

According to another aspect of the invention an in-line bag-making installation comprises:

a bag-making machine as hereinbefore described;

draw rollers mounted in line with and upstream of the bag-making machine;

a printer in line with and upstream of the draw rollers;

the printer having at least one set of printing rollers comprising an impression roller and a stereo roller and other associated rollers; and interconnecting drive means drivingly interconnecting the cylindrical roller of the bag-making machine with the draw rollers and with the or all the impression rollers of the or all the sets of printing rollers for synchronous operation of the said interconnected rollers.

The installation may include an extruder with nip rollers upstream of the printer. The installation may include a clutch between the impression roller and the stereo roller of each set of printing rollers, the clutch being disengageable to bring its associated stereo roller to a stop while film is passing over the impression roller.

The installation may include a Corona discharge unit mounted upstream of the printer and downstream of a die on the extruder, the Corona unit being adapted to treat the upper and lower surfaces of the film to accept printing.

If desired, a plurality of sets of the printing rollers, each set comprising a stereo cylinder, may be provided in series interposed between the extruder or Corona discharge unit on the one hand, and the draw rollers on the other hand. Each set of printing rollers will then be arranged to print a different colour on the film. The various sets of printing rollers will then be driven in synchronism with the draw rollers. When desired, each set of printing rollers may be declutched to permit replacement of the stereo roller thereof, even while the web of film continues to pass through the set of printing rollers.

The invention will now be described by way of example, with reference to the accompanying drawings.

Figure 1:
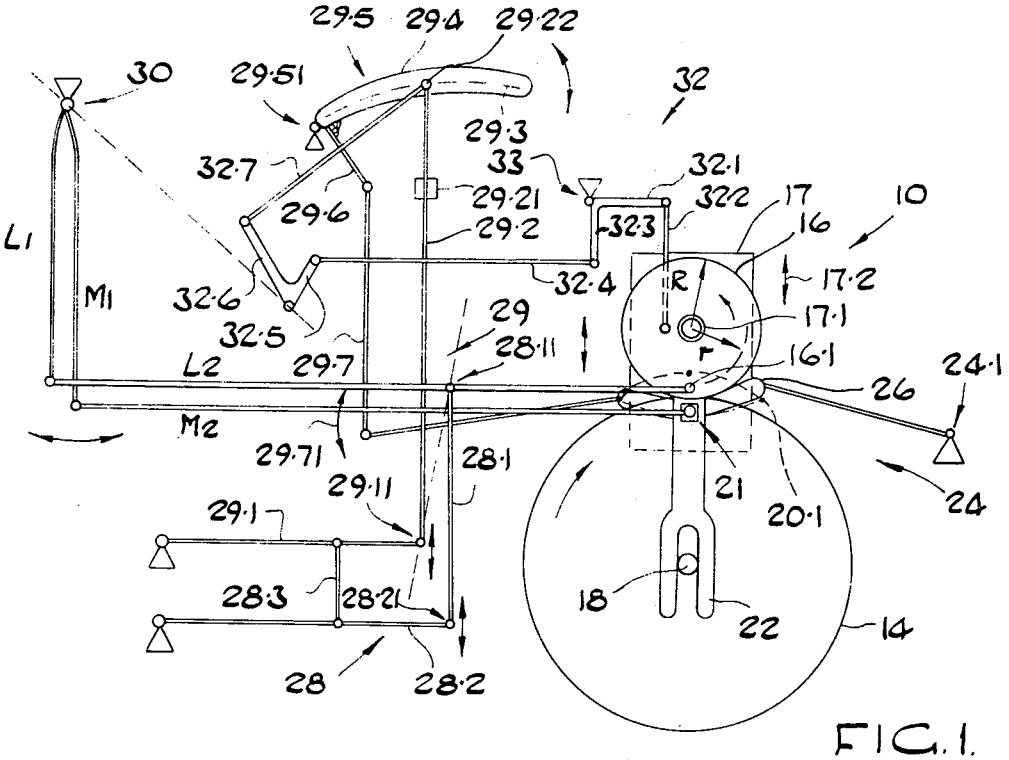
FIG. 1 shows diagrammatically a line diagram in side elevation of a roller and an automatically adjusting link lever system of a bag-making machine in accordance with the invention.

Referring to the drawings, reference numeral 10 refers generally to a bag-making machine according to the invention comprising a hollow roller 12 having a gear 14 in the form of a toothed wheel co-axial with it, whose pitch circle diameter is also represented by 14. The said gear engages with a toothed change wheel 16 whose pitch circle diameter is also represented by reference numeral 16. The change wheel is mounted on a slide member 17 having a support 17.1 for rotatably supporting the change wheel. The slide member 17 is adjustable in position in the direction of arrow 17.2 depending upon the diameter of change wheel 16 used, and acts as a bearing support for the wheel 16.

The roller 12 is mounted rotatably about the axis of shaft 18. A cutter sealing member, generally indicated by reference numeral 20, extends axially parallel to the shaft 18 of the roller and is supported at both ends of the roller by axially spaced aligned cutter sealing member holder forks 22, straddling the axle 18 of the roller. These holder forks are adapted to move arcuately with the peripheral movement of the roller, thereby to cause the cutter sealing member 20, mounted on the upper ends of the forks at 21, to move in unison with the roller over a predetermined arc length.

The forks 22 are also arranged to move radially relative to the rotational axis of the drum. The radial movement of the cutter sealing member 20 is controlled largely by means of cam slides in arms 24 arranged at opposite ends of the roller 12. The cam slides are in the form of shallow V-shaped cam tracks or paths, indicated schematically by reference numeral 26. Each arm 24 is pivotally mounted at one end, marked 24.1, and is displaceable arcuately about such pivotal axis via displacing means in the form of a link lever system or mechanism, generally indicated by reference numerals 28 and 29. Motion from a connecting rod L2 connected to a crank pin 16.1 on the crank wheel 16 is transmitted to a lever arm 28.2 via rod 28.1 pivotally connected to the rod L2 at 28.11 and to the lever arm 28.2 at 28.21. The motion of the lever arm 28.2 is transferred to a lever arm 29.1 via a rod 28.3. The lever arm 29.1 has pivotally connected to its end at 29.11, a rod 29.2 which has lost motion at 29.21. The upper end of the rod 29.2 is pivotally connected at 29.22 to a shoe (not shown) securable at varying distances along a path 29.3 of an effort arm 29.4 of a lever 29.5 having a working arm 29.6 which is connected to link 29.7 which is in turn connected to the end of the arm 24 remote from its end 24.1. When the crank pin 16.1 rotates about the axis of the change wheel 16, then the cutter sealing member 20 at the upper ends of the forks 22 moves along a locus in the form of a closed loop 20.1 cyclically in synchronism with the rotation of the change wheel 16. The cyclic period of operation of the cutter sealing member, together with the peripheral speed of the roller, will determine the length of bags made or the width of bags made, i.e. the distance between consecutive seals in a bag. Thus, bag sizes may be changed by using different diameters of change wheel 16. For a particular size of bag there will be a particular diameter of change wheel 16.

A lever having effort arm L1 and a working arm M1 is pivotable about a fulcrum 30 and has the connecting rod L2 connected to its effort arm L1 which connecting rod L2 in turn is connected to the crank pin 16.1 of the toothed change wheel 16 whose pitch circle diameter is also represented by 16. This mechanism is adapted to convert rotational movement of the crank pin 16.1 into equivalent horizontal movement via, in turn, the connecting rod L2, the effort arm L1, the fulcrum 30, the working arm M1 and a connecting rod M2 to which one of the cutter sealing member forks 22 is pivotally connected. Thus the arcuate movement of the cutter sealing member 20 and forks 22 will take place in unison with the periphery of the roller at the time of seal. The lengths of the arms L1 and M1 and of the connecting rods L2 and M2 are chosen in proportion to the pitch circle diameter of the change wheel 16 and to the radial distance of the crank pin 16.1 from the axis of the change wheel. The said arms and connecting rods are used to control the motion of the cutter sealing member 20 at sealing so that it approximates closely to that of the roller. The pivotal axes at 28.11 and 29.11 in practice coincide, this being shown in FIG. 1 by a broken line interconnecting said axes.

Automatic compensation for varying centre distances between 18 and 17.1 when change wheels 16 of different diameter are used, is provided by a lever system generally designated 32. A lever arm 32.1 is connected via a link 32.2 to the slide member 17, there being pivotal connections at each end of the link 32. A lever arm 32.3 fast with the arm 32.3 is connected via a rod 32.4 to a lever arm 32.5, there being pivotal connections at each end of the rod 32.4. A lever arm 32.6 is connected again via rod 32.7 to the connection 29.22, there being pivotal connections at each end of the rod 32.7. The arms 32.1, 32.2 form part of a lever pivotable about fulcrum 33.1; and the arms 32.5, 32.6 form part of a lever pivotable about a fulcrum coaxial with the fulcrum 30 (indicated in broken lines). For a particular diameter of change wheel 16, the pivot 29.22 will have a fixed position along the path 29.3 of the effort arm 29.4 of the lever 29.5. An increase in the said centre distance will automatically cause the connection 29.22 to move further away from the fulcrum 29.51 of the lever 25 to lengthen the effective part of the effort arm 29.4. Conversely, for a smaller centre distance the position of connection 29.22 will be nearer the ulcrum 29.51 to shorten the effective length of said effort arm. By choosing the ratios suitably the degree of displacement 29.71 of the lower end of the link 29.7 in response to rotation of the change wheel 16 is kept substantially constant regardless of the centre distance. Consequently, the degree of displacement of the cutter sealing member 20 (see locus 20.1) in a direction radial to the roller 12 is also kept substantially constant. The lever system 32 acts as compensating means for changes in centre distance and is provided to keep the lift of the cam slide constant, independent of changes in the movement originating from the crank pin 16.1 of the change wheel 16 caused by changes in the centre distance; and the link lever system 28, 29 reduces the cyclic displacement of the cutter sealing member 20 in a direction transverse to the direction of feed of the web of film 50, to less than the throw of the crank pin 16.1. The crank pin is at a radial distance $r$ from the axis of the change wheel 16, which has a radius R. For the lever system to function:

$$r/R = K$$

where $K$ = substantially constant. $K$ must have a value of unity or preferably smaller, say, 0.75, but should not be too much less than unity.

Conveniently length of arm L1/length of arm M1 is also = $K$, the link lever system thus having the arms L1 and M1 acting as proportionating lengths to give the locus 20.1 a desired diametrical dimension in the direction of feed of the web of film 50.

It will be appreciated that there are two gear wheels (engaging change wheels 16 at opposite end of the roller 12) with their associated link lever systems 28, 29, one for each of the cam slides on the arms 24. The cutter sealing member 20 is thus reciprocable and performs a working stroke in a downstream direction and a return stroke in an upstream direction, along the locus 20.1, relative to the direction of feed of the web of film 50.

Figure 2:
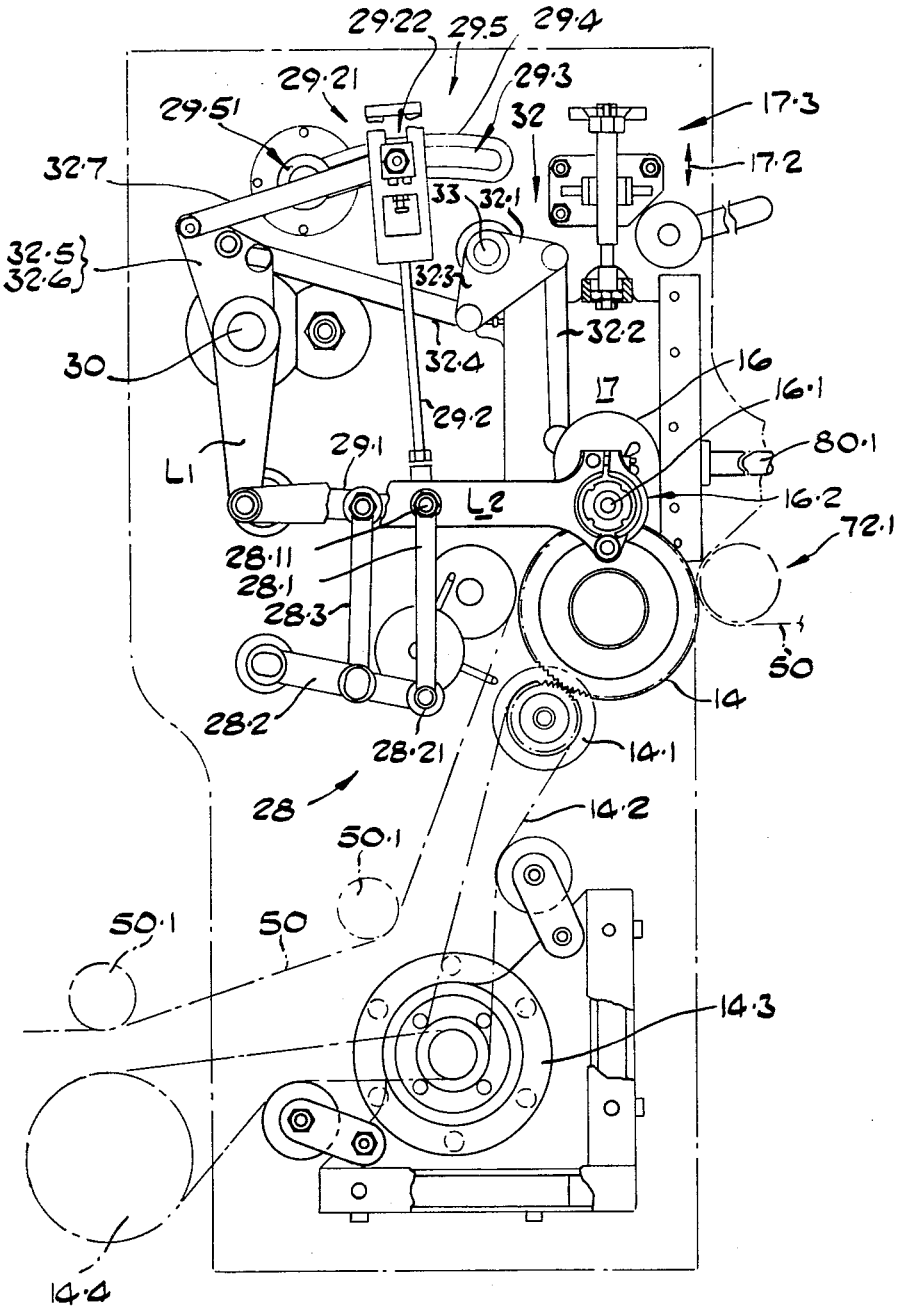
FIG. 2 shows a side elevation of a bag-making machine according to the invention embodying the link lever system of FIG. 1.

Referring now to FIG. 2, there is shown a side elevation of a machine corresponding to that shown diagrammatically in FIG. 1. Like reference numerals refer to like parts. The position of the slide 17 is adjustable by means of the adjusting means 17.3. The roller 12, via one of its gears 14, is rotated via means comprising a toothed wheel 14.1 driven by a chain 14.2 from the output of an epicyclic gearbox 14.3 whose input is driven by a chain from a prime mover or gearbox 14.4. A continuous web of heat sealable synthetic plastic material film 50 in flat tubular form from the haul-off rollers of feed means in the form of an extruder (not shown) or from a roll (not shown) passes over deflecting rollers 50.1 onto the roller 12. The connecting rod L2 is provided with a C-type clamp 16.2 for rapid connection and disconnection when change wheels 16 are being changed. The epicyclic gearbox 14.3 will facilitate registration of colours in printing (described hereunder).

Figure 3:
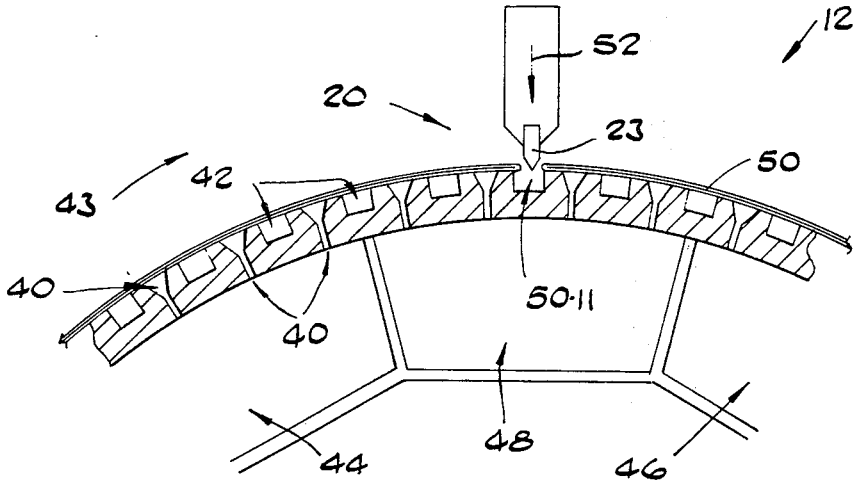
FIG. 3 shows diagrammatically a part cross-sectional view of a roller and cutter sealing member.

Referring now to FIG. 3 of the drawings, there is shown part of a roller in section, generally indicated by reference numeral 12. The roller 12 has a plurality of perforations 40, and a plurality of circumferentially spaced, axially extending slots 42 between the said perforations. The roller is arranged to rotate in the direction of arrow 43. On the inside of the roller there are provided low vacuum cavities 44 and 46, and between them a high vacuum cavity 48. When these cavities are subjected to sub-atmospheric pressure, then ambient atmospheric pressure presses upon the layers of synthetic plastic film 50 drawn against the periphery of the roller and the film thus moves with the roller as it rotates. The film 50 is fed over the roller 12 at a uniform rate corresponding to the rate of rotation of the roller. The cutter sealing member 20 is arranged to be displaced radially inwardly in the direction of arrow 52 when it is in register with a slot 42. In being displaced, the cutter sealing member 20 intersects the synthetic plastic film 50 at 50.11 where it spans the opposed edges defining the slot 42, thereby cutting through the synthetic plastic film 50 and sealing it at the same time. The cutter sealing member conveniently has a cutting element or blade 23 in the form of a heat cutter.

Figure 4:
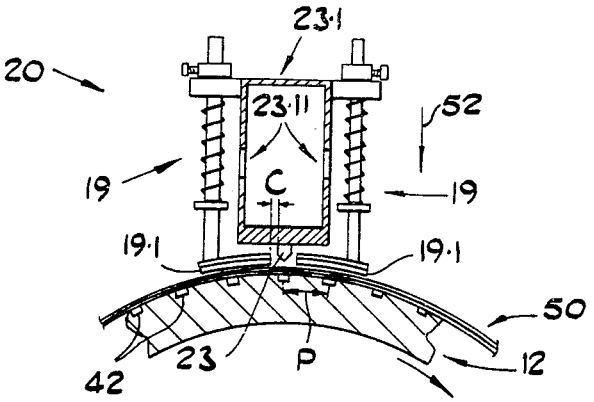
FIG. 4 shows diagrammatically on a reduced scale a further part cross-sectional view of the roller and cutter sealing member.

Referring now to FIG. 4, there is shown a cutter sealing member 20 prior to inward movement to sever the plastic film 50. The member 20 includes biassed shoes 19 on opposite sides of the blade 23. The member 20 includes a carrier 23.1 for the blade 23, the carrier 23.1 being of hollow box section provided with ventilating holes 23.11. The shoes 19 are provided by springloaded plungers mounted on the carrier 23.1 and having linings 19.1 of (polytetrafluoroethylene) PTFE. The clearance space c between the blade 23 and the opposed edges of the linings 19.1 of the shoes 19 should not exceed half the pitch p of the slots 42.

Referring now to FIGS. 5, 6, 9 and 10 of the drawings, details are shown of the roller 12 and of a take-off mechanism 82 for the roller. The take-off mechanism 82 comprises a roller 82.1 rolling via the film 50 against the roller 12, and having a peripheral speed slightly larger by, say, about 15–20% than the peripheral speed of the roller 12. This is to ensure that the film 50 is stretched on the roller 12 downstream from the cutter sealing member 20 and to ensure that the two adjacent seals become separated and do not become welded together again. The film when fed on to the roller 12 is pressed against it by one or more pressing rollers 74.3.

The roller 12, besides having the axially extending grooves 42 spaced circumferentially, also has a plurality of axially spaced circumferential grooves 12.11. The widths of the grooves 12.11 are of the order of about 1 mm. Stripper or take off members 82.2 are mounted to have their upstream ends projecting into the grooves 12.11. They act to strip bags 50.2 from the roller 12 and to guide them in co-operation with guide fingers 82.3 into intercalating corrugating rollers 82.4 and 82.5 arranged downstream from the members 82.2 and guide fingers 82.3. The corrugating rollers have undulations 82.41 and 82.51 staggered in an axial direction, and are adapted to roll past each other with clearance and out of contact with each other, and with the undulations mating to provide corrugations in the bags 50.2 as they pass between the rollers 82.4 and 82.5. In doing so, the bags acquire sufficient stiffness for them to be delivered in stacked relationship in a stacking zone 78. See also further description with reference to FIG. 14.

Figure 6:
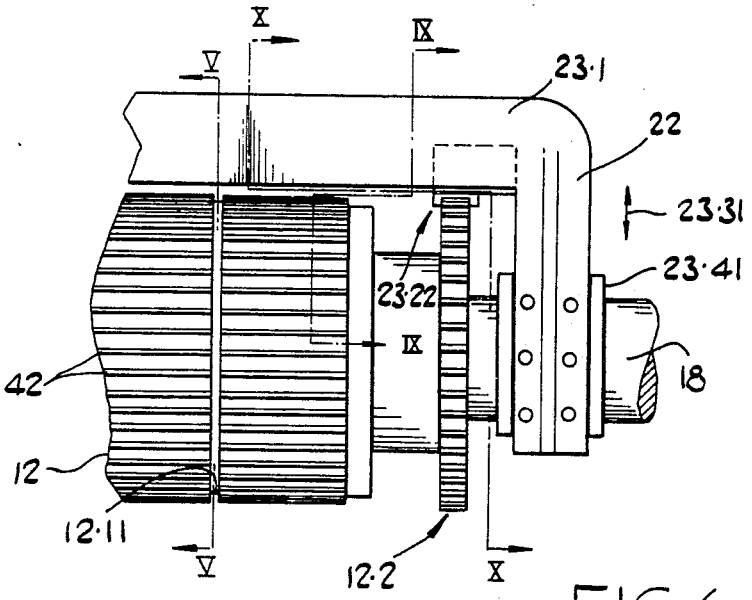
FIG. 6 shows a part front elevation of one end of the roller.

Referring now to FIG. 6 of the drawings, the cutter and sealing member carrier 23.1 has aligned forks 22 at opposite ends thereof adapted to slide reciprocating fashion in the direction of arrow 23.31, in a linear guide 23.41 within which the shaft 18, fast with the roller 12, is adapted to rotate.

The roller 12 has gears 14 at opposite ends, one of the gears being driven by toothed wheel 14.1 (see FIG. 2). The teeth of these gears are identical in number to the number of grooves 42 and at the identical pitch and are circumferentially aligned with the grooves. The carrier 23.1 is provided at each end with a mating formations in the form of a teeth 23.22 which adapted to engage on their inward movement towards the axis of the roller 12, with mating formations on the roller 12 namely the teeth of the gears 14, thereby to ensure positive location and alignment of the cutter sealing member 20 and the blade 23 in relation to the slots 42. Such interengagement of the mating formations over an arc determined by the length of the stroke as ascertained from FIG. 1, ensures that the cutter sealing member travels in unison with the roller over the arc, and that it registers accurately with a slot during such travel. The interengagement of the mating formations also ensures that the blade 23 during the period of travel of the cutter sealing member remains radially orientated relative to the roller axis.

Figure 7:
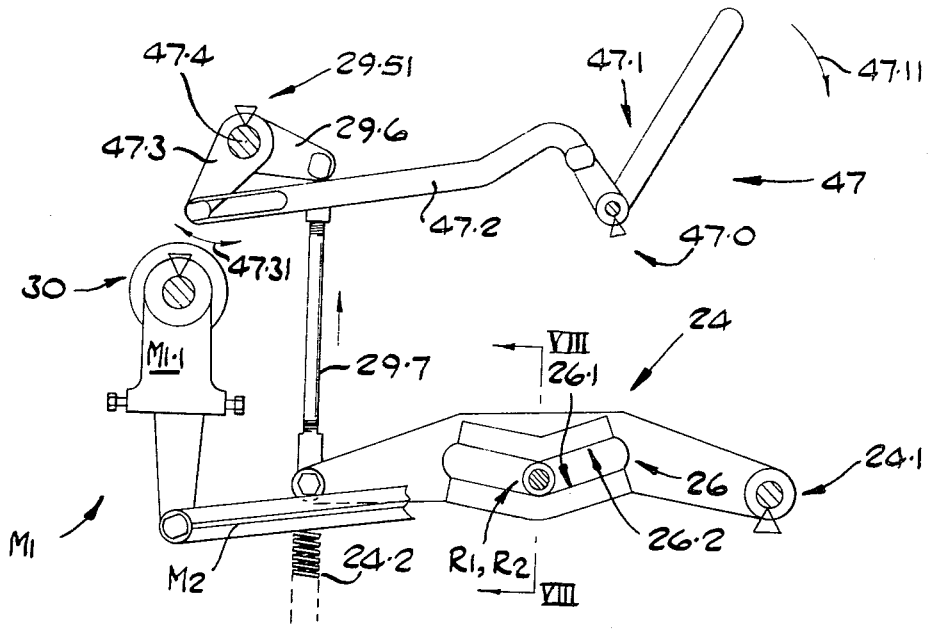
FIG. 7 shows a part side elevation of the mounting means for the cutter sealing member.
Figure 8:
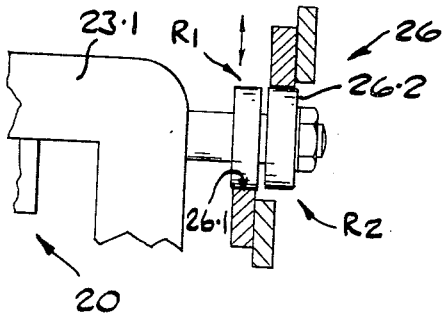
FIG. 8 shows a part section at VIII — VIII in FIG. 7.
Figure 9:
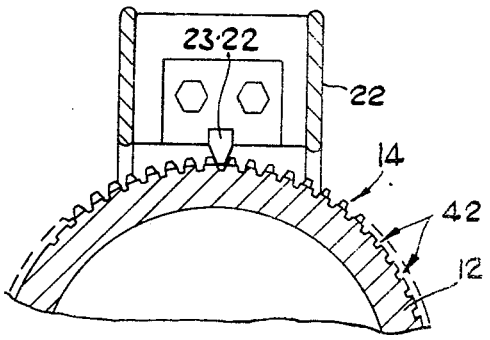
FIG. 9 shows a part cross-section at IX — IX in FIG. 6.
Figure 10:
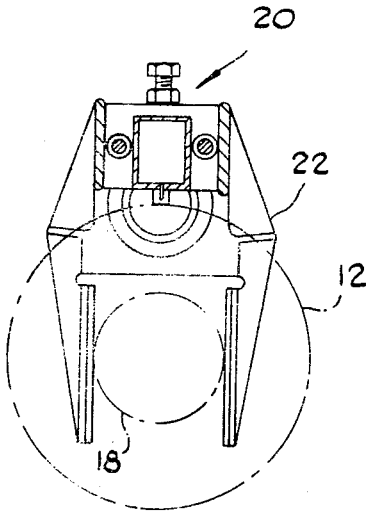
FIG. 10 shows a part cross-section at X — X in FIG. 6.

Referring now to FIGS. 7 and 8 of the drawings, there are shown details in side elevation and cross-section of parts of the machinee shown in FIG. 2. Like reference numerals refer to like parts. Each lever arm M1 includes a root part M1.1 with set screws for adjusting the angular disposition of arms M1 about a shaft axis providing the fulcrums 30. The ends of the connecting rods M2 are each provided with a pair of cam followers in the form of rollers R1 and R2 running in the cam tracks or paths 26 which are shallow and V-shaped. A pair of axially spaced rollers R1 and R2 is thus provided at each end of the cutter sealing member 20. The roller R1 runs against the lower face 26.1 of path 26, whilst the roller R2 runs against the upper face 26.2 of the path 26. Thereby slack and inaccurate location of the cutter sealing member 20 in relation to the slots 42 is avoided. In order to eliminate slack at least one of the faces 26.1 or 26.2 is made adjustable in position relative to the other. In FIG. 8, it is the upper face 26.2 which is shown to be adjustable in position relative to the lower face 26.1. Each arm 24 is provided with a spring 24.2 for pulling it down. The levers 29 and links 29.7 form cam track displacing means which operate in synchronism with, and form part of the link lever systems 28, 29 to displace the cam tracks or paths 26 on the arms 24 cylically, away from the axis of the roller 12, and towards said axis for return strokes and working strokes respectively of the cutter sealing member 20.

If the cutter sealing member has to be cleaned or if it has to be taken out of operation for any other reason, then it may be lifted out of its operating position by means of lever system 47 which includes lever 47.1 having a fulcrum 47.0, link 47.2 and lever 47.3 fast with a shaft 47.4 which is pivotable about fulcrum 29.51 and is fast with the lever arms 29.6. Link 47.2 is pivotally connected at its ends to levers 47.1 and 47.3. Pulling of lever 47.1 in direction of arrow 47.11 will cause lever 47.3 to be displaced in the direction of arrow 47.31 and hence to raise the links 29.7 and with them the arms 24 and cutter sealing member 20.

Figure 11:
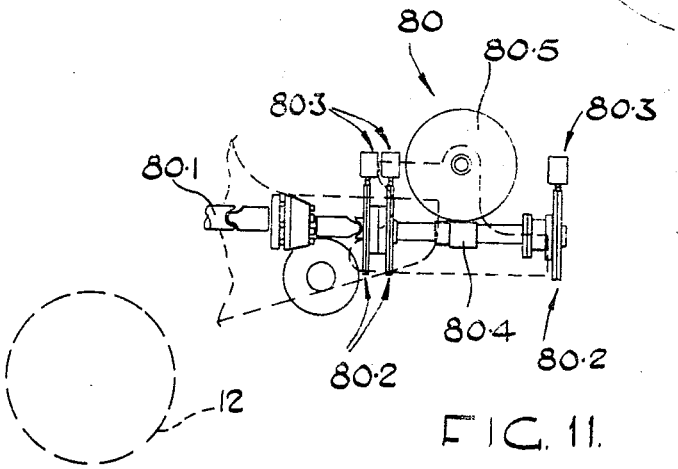
FIG. 11 shows a part side elevation of a cam assembly.

Referring now to FIG. 11 of the drawings, there is shown a counter means 80 driven in synchronism with the cutter sealing member to count the number of bags and to operate the stacking means 78 when a predetermined number of bags have been stacked on the stacking means. The counter mechanism comprises a drive shaft 80.1 driven from the gear 14 and in synchronism therewith. The drive shaft is arranged to have cam faces 80.2 which in turn operate counter mechanism 80.3. The shaft 80.1 drives a worm 80.4 engaging with a wormwheel 80.5 having an appropriate number of teeth corresponding to the number of bags which are to be stacked in the stacking zone 78, and which is adapted to actuate bag removing means when the appropriate number of bags have been stacked on the stacking zone 78. The stacking zone may thus comprise bag removing means in the form of a platform, table, or belt, which is movable in response to one or more revolutions of the wheel 80.5.

Figure 12:
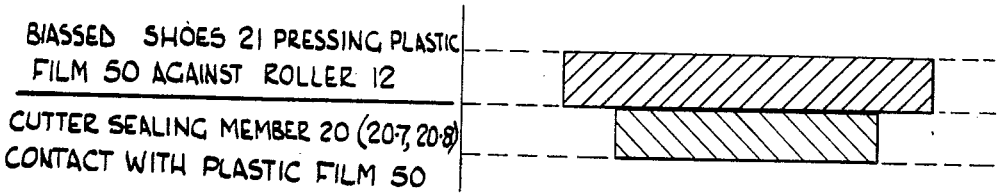
FIG. 12 shows a timing diagram showing the sequence of operations of the various components during a cycle of operations.

Referring now to FIG. 12 of the drawings, it will be noted that a timing diagram is shown. From this drawing it will be clear that for any one cycle of operation, the biassed shoes 19 will come into contact with the plastic film 50 on the roller 12, before the cutter sealing member 20 comes into contact therewith, and will still press the plastic layers against the roller, even after the cutter sealing member 20 has withdrawn.

Figure 13:
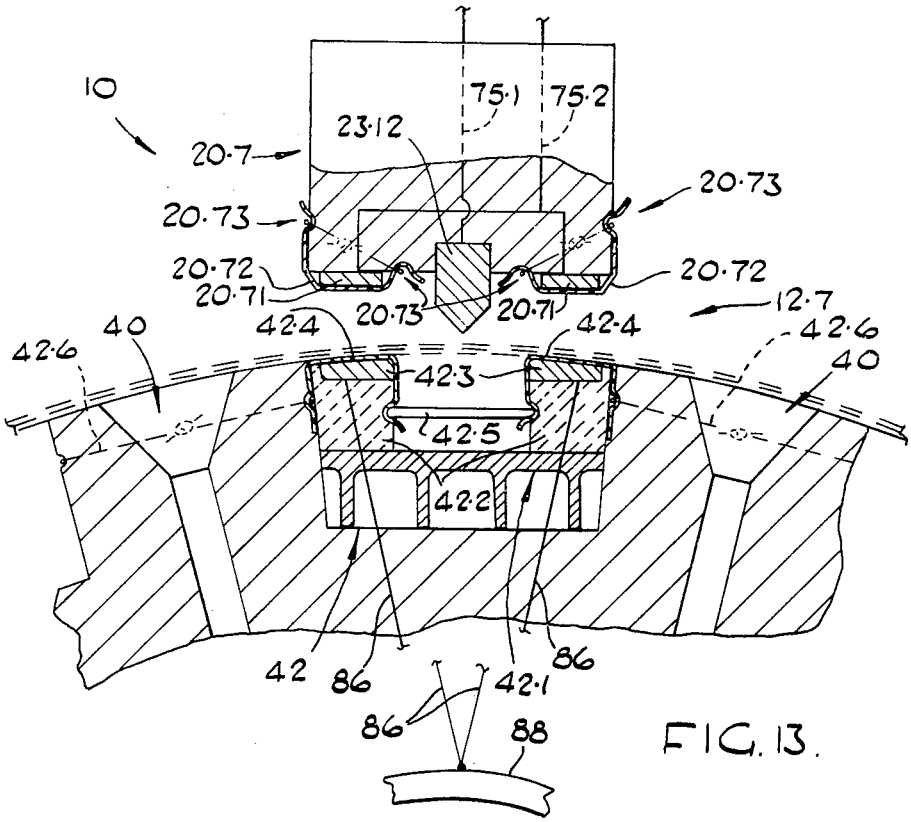
FIG. 13 shows diagrammatically a part-sectional end elevation of a double sealing cutter sealing member.
Figure 15:
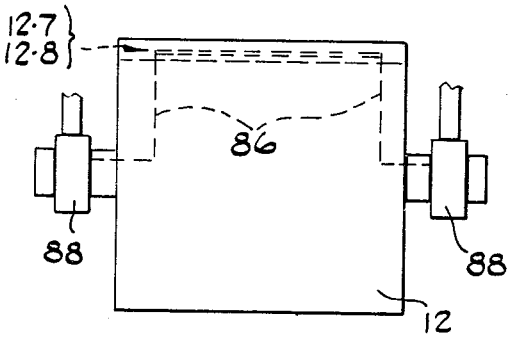
FIG. 15 shows diagrammatically a front elevation of the electrical circuitry of the cutter sealing members and rollers of FIGS. 13 and 14.

FIG. 13 shows a detail of a roller slot 42 and cutter sealing member 20.7. Inside the slot 42 there is mounted a heat sink 42.1 which may be of aluminium. There is provided an anvil 12.7 comprising on either side of the slot 42, an insulator block 42.2 on top of which there are provided heating element sealing bars 42.3 secured to the blocks 42.2 and energized by conductors 86 from slip ring 88. (See also FIG. 15). Each bar 42.3 has a covering 42.4 of polytetrafluoroethylene (PTFE) sheet, available presently under the brand name TEFLON. The sheets 42.4 are held in position over the bars 42.3 and against the blocks 42.2 by means of flat spring member 42.5 located in recesses in the blocks 42.2. The outer edges of the sheets 42.4 are held by wires 42.6 in recesses provided in the sides of the slots.

The cutter sealing member 20.7 has a heat cutter blade element 23.12 and sealing element strips 20.71. The element 23.12 and strips 20.71 are energized in parallel via conductors 75.1 and 75.2. The strips 20.71 are covered by PTFE sheets 20.72 held in position by wires seating in recesses 20.73 in the member 20.7. The element 23.12 is arranged to be at a higher temperature than the bars 42.3 and sealing element strips 20.71.

Figure 14:
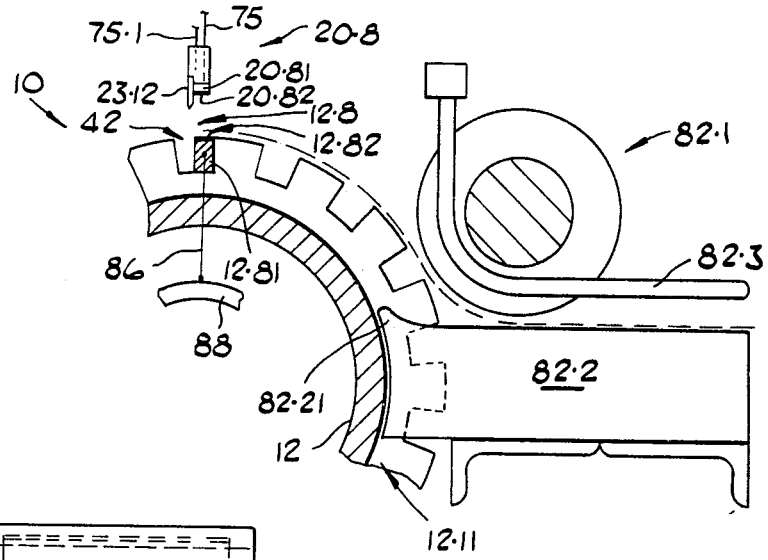
FIG. 14 shows diagrammatically a part-sectional end elevation of a bottom cutter sealing member with roller, and also a detail arrangement of take-off members.

The cutter sealing member 20.8 shown in FIG. 14, is intended specifically for bottom sealing bags, i.e. on one side of the element 23.12 only. The member 20.8 and the anvil 12.8 shown in FIG. 14, are similarly constructed, arranged and energized to the arrangement of FIG. 13, except that sealing takes place on one side only. (See also FIG. 15). The element 23.12, like the element 23.12 in FIG. 13, is arranged to be at a higher temperature than the sealing element strip 20.81 and the sealing bar 12.81. They are arranged to be energized respectively via conductors 75.1, 75.2 and 86.

To facilitate bag separation upon stripping, the anvil 12.8 may be arranged against the upstream side of the slot 42 instead of against the downstream side, as shown, the cutter sealing member 20.8 thus having its element 23.12 downstream of its sealing strip 20.81.

In both FIGS. 12 and 13 the fact that the element 23.12 is at a higher temperature than each associated sealing strip and sealing bar, and the fact that the element remains in contact with the film 50 momentarily after each strip is withdrawn from the corresponding bar, both tend to facilitate bag separation during stripping.

Figure 5:
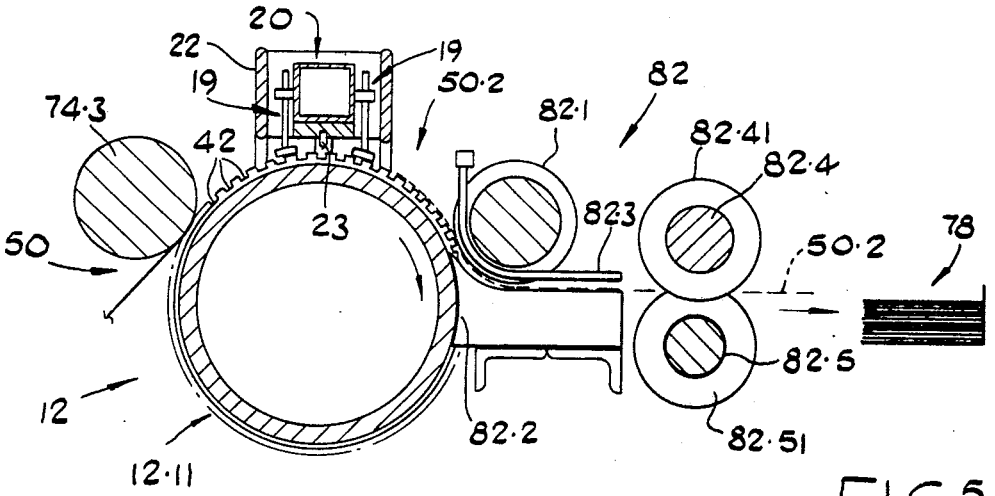
FIG. 5 shows a cross-section of the roller at V — V in FIG. 6 of that part of the machine downstream from the roller.

FIG. 14 also shows details of the take off arrangement shown generally in FIG. 5. It will be noticed that the circumferential groove 12.11 is deeper than the slots 42. The upstream ends 82.21 of the take off members 82.2 project radially into the grooves 12.11 to a position radially inwardly of, and closer to the axis of the roller than, the bottoms of the slots 42. The PTFE covering for the bar 12.81 is shown at 12.82; and the PTFE covering for the strip 20.81 is shown at 20.82.

A bag making machine as described above ensures accurate placement of cut and seal. This is particularly useful where film having printed matter on it has to be processed. The machine is therefore particularly useful for in line operation with an extruder and printer installation. An example of such an installation will now be described with reference to FIGS. 16, 17 and 18 of the drawings.

Figure 16:
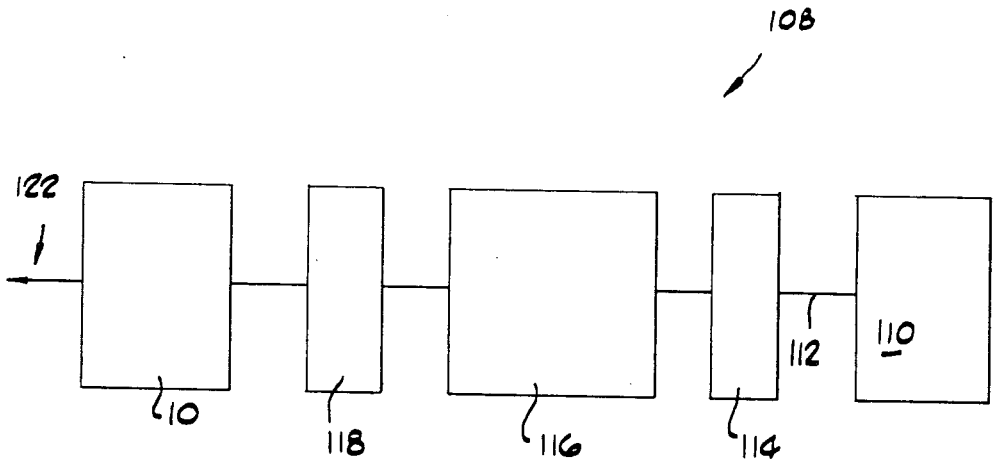
FIG. 16 shows diagrammatically a block diagram showing the progress of film from an extruder through to the finished bags.
Figure 18:
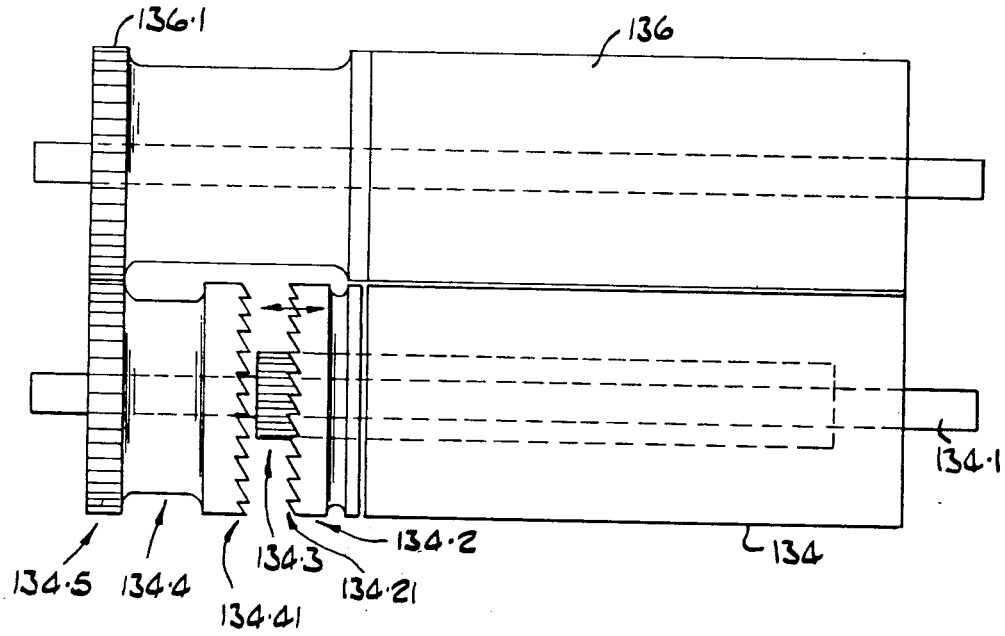
FIG. 18 shows in front elevation thereof the arrangement of the clutch on an impression roller, and the associated stereo cylinder.
Figure 17:
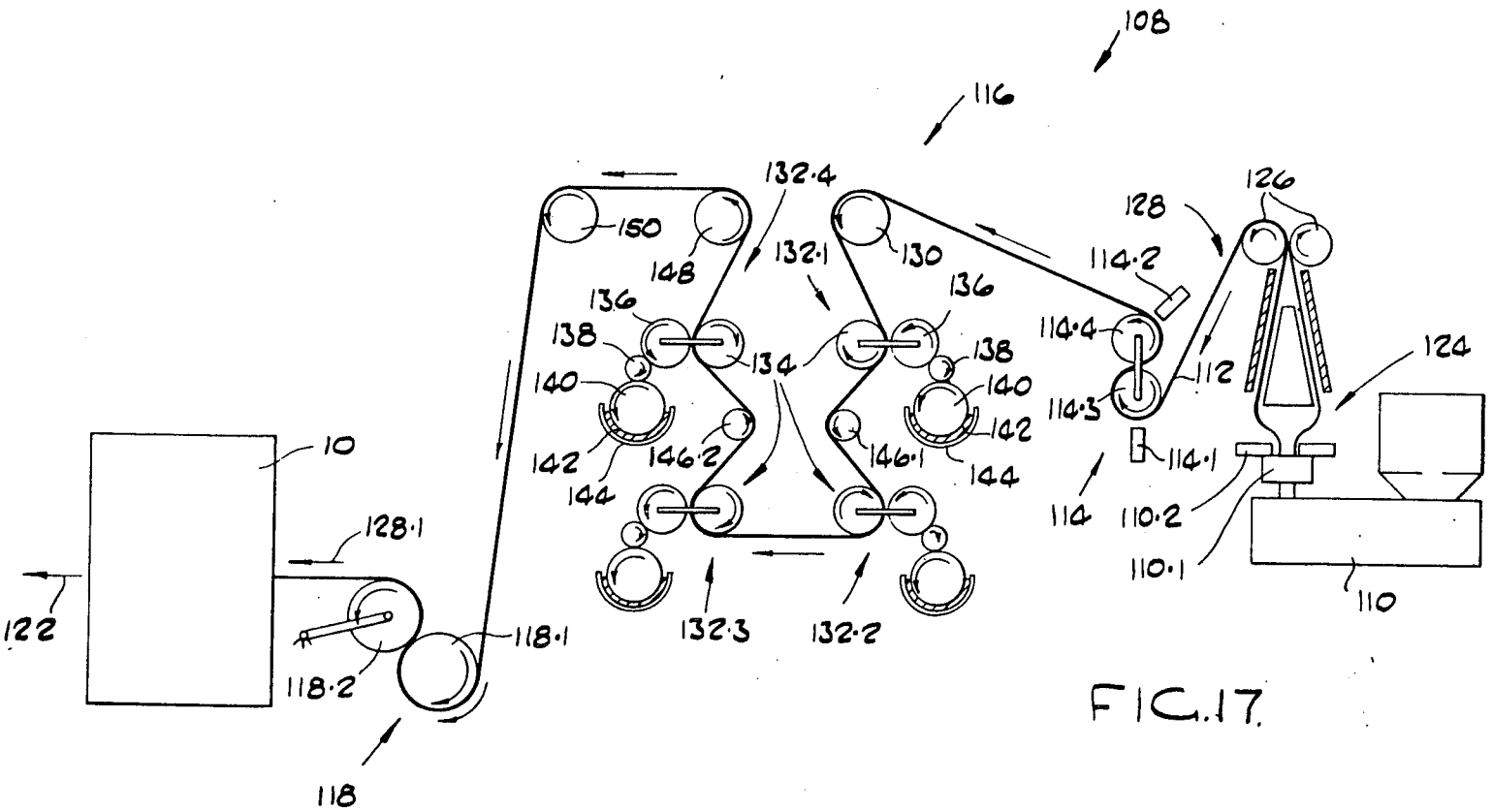
FIG. 17 shows diagrammatically a side elevation of an in line bag-making installation comprising various sets of apparatus arranged in accordance with the invention.

Referring to FIGS. 16, 17, and 18 of the drawings, reference numeral 108 refers generally to an installation in accordance with the invention, comprising an extruder 110 feeding film 112 into a Corona discharge unit 114 for treating the film to accept printing. From the Corona discharge unit the film passes into the printer 116 and thence through draw rollers 118 to bag-making machine 10, as described above. The finished bags issue at 122 from the bag-making machine.

Referring now particularly to FIG. 17 of the drawings, the extruder 110 has a die 110.1 and a cooling air ring 110.2. The film is blown in the form of a bubble 124. It passes between the nip rollers 126. It then passes in the form of a collapsed tube 128 through the Corona discharge unit 114 having the Corona discharge bars 114.1 and 114.2. In passing through the Corona discharge unit, the film passes over the rollers 114.3 and 114.4. These rollers are merely idler rollers. The film then passes into the printer, generally indicated by reference numeral 116. This printer comprises a deflecting roller 130.

After passing over the deflecting roller 130, the film passes into the first set of printing rollers 132.1. A set of printing rollers comprises a driven impression roller 134, a stereo cylinder 136 drivingly interconnected with the impression roller 134, a transfer or anilox roller 138, and an inking roller 140. The inking roller is adapted to dip into ink 142 held in a tray 144. Thereafter the film passes over a deflecting roller 146.1, and thence into the next set of printing rollers 132.2. Thereafter the film passes into the third set of printing rollers 132.3 and thence, after passing over a deflecting roller 146.2, it passes into the fourth set of printing rollers 132.4. Thence the film passes over a deflecting roller 148, over a further deflecting roller 150, and thence onto the draw rollers, generally indicated by reference numeral 118.

These draw rollers comprise a drive roller 118.1 which is driven in the direction of the arrow shown. The other roller 118.2 of the draw rollers is biassed to roll on the film against the drive roller 118.1. Thereafter the film passes in the direction of arrow 128.1, into the bag-making machine 10. The bags issue as indicated, at 122.

All the impression rollers 134 and the driving draw roller 118.1, are driven in synchronism from a suitably rotary power source. The various rollers may conveniently be interconnected by drive shafting, or by chain drive to rotate at the appropriate speeds. Alternatively, they may be driven by suitable interlocked electrical drive means arranged to run in synchronism with each other.

Any one of the sets of printing rollers may be taken out of commission by merely disengaging the drive from the impression roller of that set, to its stereo cylinder. This may be done by declutching the stereo cylinder from the impression roller.

Referring now to FIG. 18 of the drawings, there is shown an impression roller 134 which receives rotary drive at its shaft 134.1. A toothed sliding member 134.2 is axially slidable on a splined portion 134.3 fast with the roller 134. The teeth 134.21 of the slidable portion are engageable with teeth 134.41 of a mating portion 134.4 which is freely rotatable about the shaft 134.1. The part 134.4 has teeth 134.5 meshing with teeth 136.1, fast with the stereo roller 136. The drive between the impression roller 134 and the stereo cylinder 36, may be engaged or disengaged by suitably positioning the clutch member 134.2, i.e. by bringing the teeth 134.21 and 134.41 into or out of engagement, as desired. When the member 134.2 and portion 134.4 are out of engagement as shown in the drawing then the shaft 134.1 rotates freely within the portion 134.4 and no torque is transmitted to the roller 136 via the teeth 134.5 and 136.1. The sliding member 134.2 thus acts as a clutch between the stereo roller and the impression roller.

This facility permits the changing of stereo cylinders even while the film continues to pass over the impression roller 134.

This apparatus has the advantage that it makes possible to economic production of small runs of printed bags.

We claim:

1. A bag-making machine which includes:

a. a cylindrical roller having means to rotate said roller about its axis, and having a plurality of circumferentially spaced longitudinal slots in its periphery;

b. feed means adapted to feed a continuous web of heat-sealable synthetic plastics material to the roller at a rate corresponding to the rate of rotation of the roller;

c. a cutter sealing member disposed transversely to the direction of feed of the web, the cutter sealing member having a blade adapted in operation to register with and to enter into a slot of the roller;

d. mating formations fast with the roller and the cutter sealing member respectively;

e. displacing means for cyclically displacing the cutter sealing member arcuately about and radially relative to the roller axis and in synchronism with the roller, the displacing means comprising a link system for imparting reciprocating movement to the cutter sealing member to perform a working stroke in a downstream direction, and a return stroke in an upstream direction relative to the direction of feed of the web;

f. cam tracks at opposite ends of the roller and extending in the direction of feed of the web;

g. cam track displacing means adapted to operate in sychronism with the link lever system for displacing the cam tracks cyclically away from the roller axis for a return stroke and towards the roller axis for a working stroke of the cutter sealing member; and h. cam followers on the cutter sealing member adapted to co-operate with the cam tracks;

the mating formation for the roller including a toothed wheel fast and co-axial with the roller, the number of teeth of the wheel corresponding to the number of slots in the roller, and the mating formation for the cutter sealing member including at least one tooth adapted to mesh with the said toothed wheel, the mating formations being adapted to engage with each other at the start of a working stroke, and to move in unison with each other during the working stroke over an arc about the roller axis, and to disengage from each other at the end of the working stroke, the mating formations being adapted to ensure, upon inter-engagement with each other, that the cutter blade registers accurately with and remains in registration with a slot in the roller surface during the period of the working stroke, during which period sealing and cutting of the film layers is taking place, the cutter sealing member being adapted in operation in following the cam tracks cyclically to move towards and away from the roller axis and to seal and to cut the film layers in a direction transverse to the direction of feed of the web, and after such sealing and cutting, to move clear of the web and to return to its initial position for a new cycle of operation.

2. A machine as claimed in claim 1, in which the cam tracks are provided in members mounted to pivot about an axis parallel to the roller axis, and in which the cam track displacing means comprises link means interconnecting the members to the link lever system.

3. An inline bag-making installation comprising:
a bag-making machine as claimed in claim 1;
draw rollers mounted in line with and upstream of the bag-making machine;
a printer in line with and upstream of the draw rollers, the printer having at least one set of printing rollers comprising an impression rollers and a stereo roller and other associated rollers; and
interconnecting drive means drivingly interconnecting the cylindrical roller of the bag-making machine with the draw rollers and with the or all the impression rollers of the or all the sets of printing rollers for synchronous operation of rollers driven by said interconnecting drive means.

4. An inline installation as claimed in claim 3, in which there is provided an extruder with nip rollers, upstream of the printer.

5. An inline installation as claimed in claim 3, in which there is provided a clutch between the impression roller and the stereo roller of each set of printing rollers, the clutch being disengageable to bring its associated stereo roller to a stop while film is passing over the impression roller.

6. A machine as claimed in claim 1, in which the link lever system includes a toothed change wheel having means for driving said wheel in synchronism with the roller, the change wheel having a crank pin or eccentric to which the link lever system is pivotally connected.

7. A machine as claimed in claim 6, in which the change wheel is in driving engagement with the toothed wheel which in turn is fast with and co-axial with the roller.

8. A machine as claimed in claim 6, in which the link lever system is arranged to reduce the cyclic displacement of the cutter sealing member in a direction transverse to the direction of feed of the web to a value less than the throw of the crank pin or eccentric of the change wheel.

9. A machine as claimed in claim 6, in which the link lever system includes compensating means to compensate automatically for varying centre distances resulting from varying diameters of change wheels.

10. A machine as claimed in claim 9, in which the compensating means includes means for automatically shortening or lengthening the effort arm of a lever of the link lever system in response to a changed position of the rotational axis of the change wheel.

11. A machine as claimed in claim 6, in which the crank pin or eccentric is at a radius different from the pitch circle radius of the change wheel, and in which proportionate lengths of levers are used in the link lever system.

12. A bag-making machine which includes:
a. a cylindrical roller having means to rotate said roller about its axis and having a plurality of circumferentially spaced longitudinal slots in its periphery;
b. feed means adapted to feed a continuous web of heat-sealable synthetic plastics material to the roller at a rate corresponding to the rate of rotation of the roller;
c. a cutter sealing member disposed transversely to the direction of feed of the web, the cutter sealing member having a blade adapted in operation to register with and to enter into a slot of the roller;
d. mating formations fast with the roller and with the cutter sealing member respectively, the mating formations being adapted to engage with each other at the start of a working stroke, and to move in unison with each other during the working stroke over an arc about the roller axis, and to disengage from each other at the end of the working stroke, the mating formations being adapted to ensure, upon interengagement with each other, that the cutter blade registers accurately with and remains in registration with a slot in the roller surface during the period of the working stroke, during which period sealing and cutting of the film layers is taking place;
e. displacing means for cyclically displacing the cutter sealing member arcuately about and radially relative to the roller axis and in synchronism with the roller, the displacing means comprising a link lever system for imparting reciprocating movement to the cutter sealing member to perform a working stroke in a downstream direction, and a return stroke in an upstream direction relative to the direction of feed of the web;
f. cam tracks at opposite ends of the roller and extending in the direction of feed of the web;
g. cam track displacing means adapted to operate in synchronism with the link lever system for displacing the cam tracks cyclically away from the roller axis for a return stroke and towards the roller axis for a working stroke of the cutter sealing member; and
h. cam followers on the cutter sealing member adapted to co-operate with the cam tracks; the cutter sealing member being adapted in operation in following the cam tracks cyclically to move towards and away from the roller axis and to seal and to cut the film layers in a direction transverse to the direction of feed of the web, and after such sealing and cutting, to move clear of the web and to return to its initial position for a new cycle of operation, the link lever system including a toothed change wheel having means for driving it in synchronism with the roller, and the change wheel having a crank pin or eccentric to which the link lever system is pivotally connected.

13. A machine as claimed in claim 12, in which the change wheel is in driving engagement with a toothed wheel fast with the roller and co-axial with it, the said toothed wheel having a number of teeth equal to that of the number of slots in the roller.

14. A machine as claimed in claim 12, in which the cam tracks are provided in members mounted to pivot about an axis parallel to the roller axis, and in which the cam track displacing means comprises link means interconnecting the members to the link lever system.

15. A machine as claimed in claim 12, in which the link lever system is arranged to reduce the cyclic displacements of the cutter sealing member in a direction transverse to the direction of feed of the web to a value less than the throw of the crank pin or eccentric of the change wheel.

16. A machine as claimed in claim 12, in which the link lever system includes compensating means to compensate automatically for varying center distances resulting from varying diameters of change wheels.

17. A machine as claimed in claim 16, in which the compensating means includes means for automatically shortening or lengthening the effort arm of a lever of the link lever system in response to a changed position of the rotational axis of the change wheel.

18. A machine as claimed in claim 12, in which the crank pin or eccentric is at a radius different from the pitch circle radius of the change wheel, and in which proportionate lengths of levers are used in the link lever system.

19. An inline bag-making installation comprising:

a bag-making machine as claimed in claim 12;

a draw rollers mounted in line with and upstream of the bag-making machine;

a printer in line with and upstream of the draw rollers, the printer having at least one set of printing rollers comprising an impression roller and a stereo roller and other associated rollers; and interconnecting drive means drivingly interconnecting the cylindrical roller of the bag-making machine with the draw rollers and with the or all the impression rollers of the or all the sets of printing rollers for synchronous operation of the rollers driven by said interconnecting drive means.

20. An inline installation as claimed in claim 19, in which there is provided an extruder with nip rollers, upstream of the printer.

21. An inline installation as claimed in claim 19, in which there is provided a clutch between the impression roller and the stereo roller of each set of printing rollers, the clutch being disengageable to bring its associated stereo roller to a stop while film is passing over the impression roller.

22. A bag-making machine which includes:

a. a cylindrical roller having means to rotate said roller about its axis;

b. feed means adapted to feed a continuous web of heat-sealable synthetic plastics material to the roller at a rate corresponding to the rate of rotation of the roller;

c. a cutter sealing member disposed transversely to the direction of feed of the web;

d. displacing means for cyclically displacing the cutter sealing member arcuately about and radially relative to the roller axis and in synchronism with the roller, the displacing means comprising a link lever system for imparting reciprocating movement to the cutter sealing member to perform a working stroke in a downstream direction, and a return stroke in an upstream direction relative to the direction of feed of the web;

e. cam tracks at opposite ends of the roller and extending in the direction of feed of the web;

f. cam track displacing means adapted to operate in synchronism with the link lever system for displacing the cam tracks cyclically away from the roller axis for a return stroke and towards the roller axis for a working stroke of the cutter sealing member; and g. cam followers on the cutter sealing member adapted to co-operate with the cam tracks;

the cutter sealing member being adapted in operation in following the cam tracks cyclically to move towards and away from the roller axis and to seal and cut the film layers in a direction transverse to the direction of feed of the web, and after such sealing and cutting, to move clear of the web and to return to its initial position for a new cycle of operation, the link lever system including a toothed change wheel having means for driving said wheel in synchronism with the roller, the change wheel having a crank pin or eccentric to which the link lever system is pivotally connected.

23. An inline bag-making installation comprising:

a bag-making machine as claimed in claim 22;

draw rollers mounted in line with and upstream of the bag-making machine;

a printer in line with and upstream of the draw rollers, the printer having at least one set of printing rollers comprising an impression roller and a stereo roller and other associated rollers; and interconnecting drive means drivingly interconnecting the cylindrical roller and the bag-making machine with the draw rollers and with the or all the impression rollers of the or all the sets of printing rollers for synchronous operation of the said interconnected rollers.

* * * * *